US006955488B2

(12) United States Patent
Uehara

(10) Patent No.: US 6,955,488 B2
(45) Date of Patent: Oct. 18, 2005

(54) PRINTER PROVIDED WITH PAPER WINDER

(75) Inventor: Shigehiko Uehara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/826,694

(22) Filed: Apr. 19, 2004

(65) Prior Publication Data

US 2004/0265030 A1 Dec. 30, 2004

(30) Foreign Application Priority Data

Apr. 18, 2003 (JP) ..... 2003-114347

(51) Int. Cl.[7] ..... B41J 15/04; B41J 29/02; B41J 15/16

(52) U.S. Cl. ..... 400/692; 400/693; 400/613

(58) Field of Search ..... 400/120.01, 124.01, 400/611, 613, 614, 621, 691, 692, 693

(56) References Cited

U.S. PATENT DOCUMENTS 6,022,158 A * 2/2000 Nakayama et al. ..... 400/613
6,155,730 A * 12/2000 Nakayama et al. ..... 400/613
6,808,327 B2 * 10/2004 Iwata ..... 400/693

FOREIGN PATENT DOCUMENTS

| | | | |
|---|---|---|---|
| JP | 08-207371 | * | 8/1996 |
| JP | 10-101252 | * | 4/1998 |
| JP | 10-278369 | * | 10/1998 |
| JP | 11-240650 | * | 9/1999 |
| JP | 2001-310522 | * | 6/2001 |

* cited by examiner

*Primary Examiner*—Leslie J. Evanisko
(74) *Attorney, Agent, or Firm*—Nixon & Vanderhye P.C.

(57) ABSTRACT

A fixed frame has a bucket in which rolled paper is stored. A movable frame is movably attached to the fixed frame such that a passage, through which paper drawn out from the rolled paper is transported, is formed between the fixed frame and the movable frame when the movable frame is placed at a first position, and such that the passage is opened when the movable frame is placed at a second position. A printing head is disposed at a printing section, adjacent the passage. The printing head is provided on one of the fixed frame and the movable frame. A winding shaft is mounted on the fixed frame to wind up the paper that is transported through the printing section. The movable frame is formed with an opening through which the winding shaft passes when the movable frame is moved between the first position and the second position.

11 Claims, 6 Drawing Sheets

PRINTER PROVIDED WITH PAPER WINDER

BACKGROUND OF THE INVENTION

The present invention relates to a printer, and more particularly to a printer provided with a mechanism for winding up recording paper which has passed through a printing position of a printing head.

Generally, a printer for performing printing on rolled recording paper is mounted on a POS terminal or the like. In order to facilitate exchange and loading of the rolled recording paper by opening a transporting passage of the recording paper, which is formed between a printing head and a platen arranged close to and opposed to the printing head, there is known a printer of such a type that the platen and other members are mounted on a movable frame which can be opened or closed. There is also known a printer which is provided with a mechanisms for winding up the recording paper passed between the printing head and the platen, for the purpose of storing the printed recording paper.

In this printer, a winding shaft for the recording paper to be wound around is usually provided on the movable frame, because the winding shaft must be taken out on occasion for exchanging the wound paper. Moreover, both ends of the winding shaft are fitted in grooves which are formed with the movable frame and opened upward, so that the winding shaft can be easily taken out. Such a configuration is disclosed in Japanese Patent Publication No. 10-101252A, for example.

One example of a printer having such structure will be described with reference to FIGS. 6A and 6B. As shown in FIG. 6A, a printer body 101 has a fixed frame 103 and a movable frame 104 which is attached to the fixed frame 103 through rotary bearings 109. The fixed frame 103 is further provided with a bucket 112 for accommodating rolled recording paper 102, and a printing head 108 for performing printing on recording paper 102*a* which has been drawn out from the rolled recording paper 102.

The movable frame 104 is provided with a platen 107 which is opposed to the printing head 106 and a fixed distance from the printing head 106 when the movable frame 104 is closed, a paper feeding roller 108 for transporting the recording paper 102*a* which has been drawn out from the rolled recording paper 102, and grooves 111 for receiving a winding shaft 105 which winds up the recording paper 102*a* that has passed the paper feeding roller 108. The winding shaft 105 is mounted so as to rotate with both ends 110 thereof set respectively in the grooves 111.

The recording paper 102*a* which has been drawn out from the rolled recording paper 102 is transported by the paper feeding roller 108, and printing is performed while the recording paper passes between the printing head 106 and the platen 107. Thereafter, the recording paper 102*a* is wound up by the winding shaft 105.

When the rolled recording paper 102 is to be exchanged, it is necessary to open the movable frame 104. When a user tries to open the movable frame 104 by more then 90 degrees as shown in FIG. 6B, however, the winding shaft 108 may fall from the grooves 111, as indicated by an arrow G.

Moreover, since the rotary bearings 109 of the movable frame 104 and the grooves 111 are not aligned as shown in FIG. 6A, a moment will be exerted in a closing direction of the movable frame 104 due to a weight of recording paper 7*a* which has been wound around the winding shaft 105. In addition, a significant change in the weight of the recording paper 7*a* may affect the opening and closing motions of the movable frame 104. Further, in a case where the rotary bearings 109 and the grooves 111 are aligned in position in order to eliminate this moment as described in Japanese Patent Publication No. 10-101252A, another problem that a layout design may be inflexible and design freedom may be lost.

SUMMARY OF THE INVENTION

It is therefore an object of the invention to provide a printer in which a movable frame can be opened or closed without being affected by a winding shaft and rolled recording paper, while maintaining the exchange facility of the winding shaft.

In order to achieve the above object, there is provided a printer including;

a fixed frame, having a bucket in which rolled paper is stored;

a movable frame movably attached to the fixed frame such that a passage, through which paper drawn out from the rolled paper is transported, is formed between the fixed frame and the movable frame when the movable frame is placed at a first position, and such that the passage is opened when the movable frame is placed at a second position;

a printing head disposed at a printing section adjacent the passage, the printing head being provided on one of the fixed frame and the movable frame; and a winding shaft mounted on the fixed frame that winds up the paper which is transported through the printing section, wherein the movable frame is formed with an opening through which the winding shaft passes when the movable frame is moved between the first position and the second position.

In such a configuration, since the passage including the printing section is opened by opening the movable frame (at the second position), the replacement of the rolled paper can be easily conducted. Further, since the winding shaft is not mounted on the movable frame but the fixed frame, and the movable frame can be pivoted without interfering with the winding shaft, the replacement of the winding shaft and the rolled paper can be easily conducted. As a result, the invention can solve those problems that it has been difficult to extensively open the movable frame, and that the opening and roofing motion has been difficult due to the bending moment.

Preferably, the fixed frame is formed with at least one groove revolving the winding shaft rotatebly.

In such a configuration, the winding shaft can be easily mounted on or detached from the fixed frame.

Preferably, the printer further includes:

a paper feeding roller disposed adjacent the passage downstream of the printing section, the paper feeding roller being provided on one of the fixed frame and the movable frame; and a motor for rotating the paper feeding roller to transport the paper along the passage.

In such a configuration, the passage is opened by opening the movable frame. Accordingly, replacement of the rolled paper can be easily conducted.

Here, it is preferable that the winding shaft is rotated synchronously with the paper feeding roller.

In such a configuration, the paper is wound up without being slacked or being excessively tensed.

It is further preferable that the winding shift is rotated by the motor. In this case, since a single motor is commonly used for the paper feeding roller and the winding shaft, the printer can be downsized. Further, synchronous driving can be easily attained.

It is further preferable that the printer also includes:

a first transmission mechanism, provided in one of a left side and a right side of the printer to transmit a driving force from the motor to the paper feeding roller; and a second transmission mechanism, provided in the other one of the left side and the right side of the printer to transmit a driving force from the paper feeding roller to the winding shaft.

In such a configuration, the space inside the printer can be efficiently utilized to downsize the printer.

It is also preferable that the passage includes a first passage extending from the printing section and an outlet, and a second passage extending from the printing section to the winding shaft. Here, the paper is double-ply paper so that a first separated paper is transported along the first passage to be ejected from the outlet, and a second separated paper is transported along the second passage to be wound around the winding shaft.

Preferably, the printer further includes;

a cover attached to the fixed frame so as to cover the bucket, the cover being pivotable between a first position and a second position; and a cutting mechanism provided with the cover to cut the first separated paper.

Here, a lower face of the cutting mechanism and an upper face of the movable frame define the second passage when the cover is placed at the first position, and the second passage is opened when the cover is placed at the second position.

In such a configuration, replacement of the winding shaft can be easily conducted.

Preferably, the cover is pivotable independent from the movable frame. In such a configuration, replacement of the winding shaft and the rolled paper can be easily conducted. Further, the recovery operation from a paper jam can be also easily conducted.

Preferably, the printing head is a dot impact type head.

BRIEF DESCRIPTION OF THE DRAWINGS

The above objects and advantages of the present invention will become more apparent by describing in detail preferred exemplary embodiments thereof with reference to the accompanying drawings, wherein.

Figure 1:
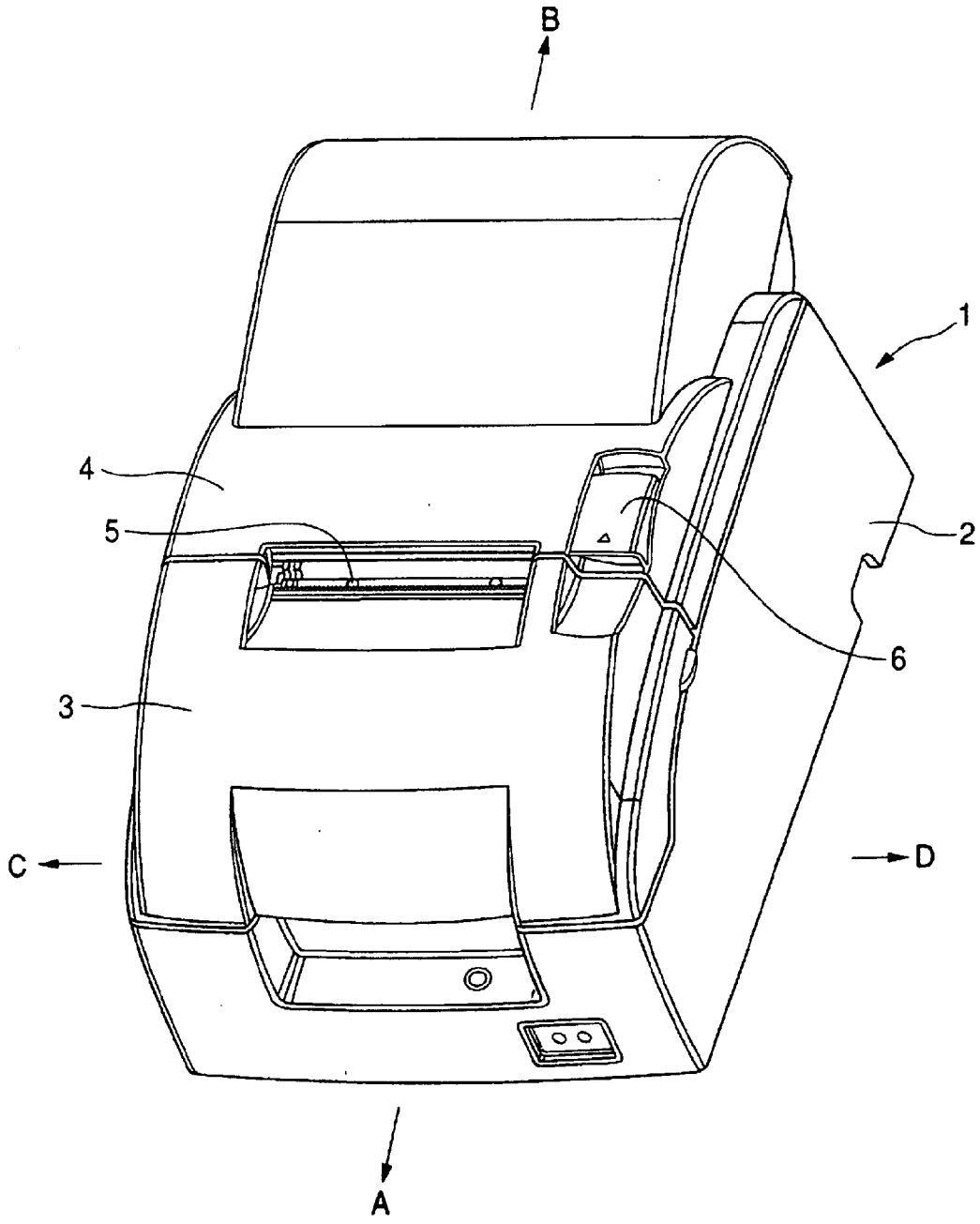
FIG. 1 is a perspective view of an outer appearance of a printer.

DETAILED DESCRIPTION OF THE INVENTION.

Preferred embodiments will be described below in detail with reference to the accompanying drawings.

Now, referring to the drawings, an embodiment of the printer according to the invention will be described.

Figure 2:
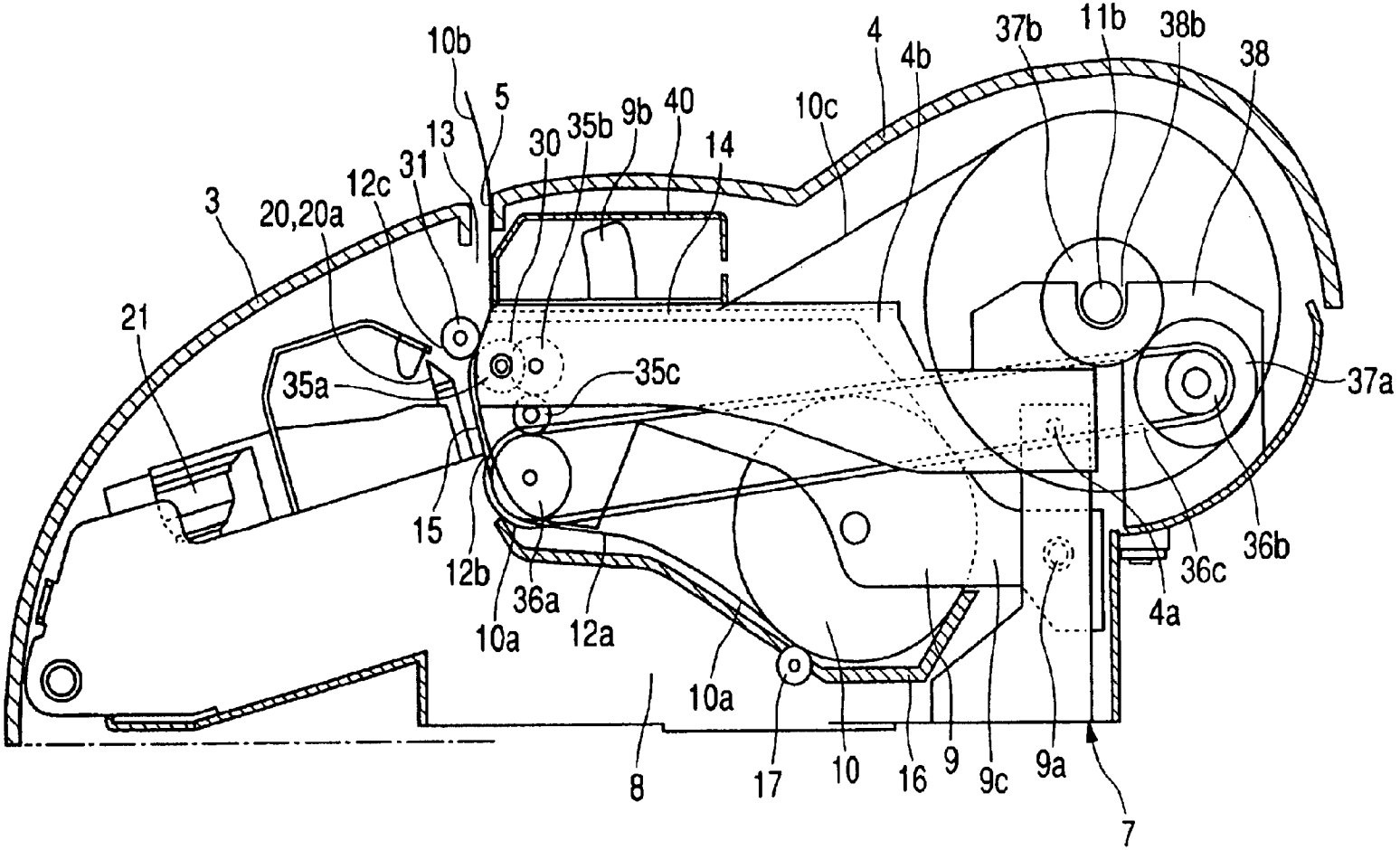
FIG. 2 is a right side view of a printer body incorporated in the printer.
Figure 3:
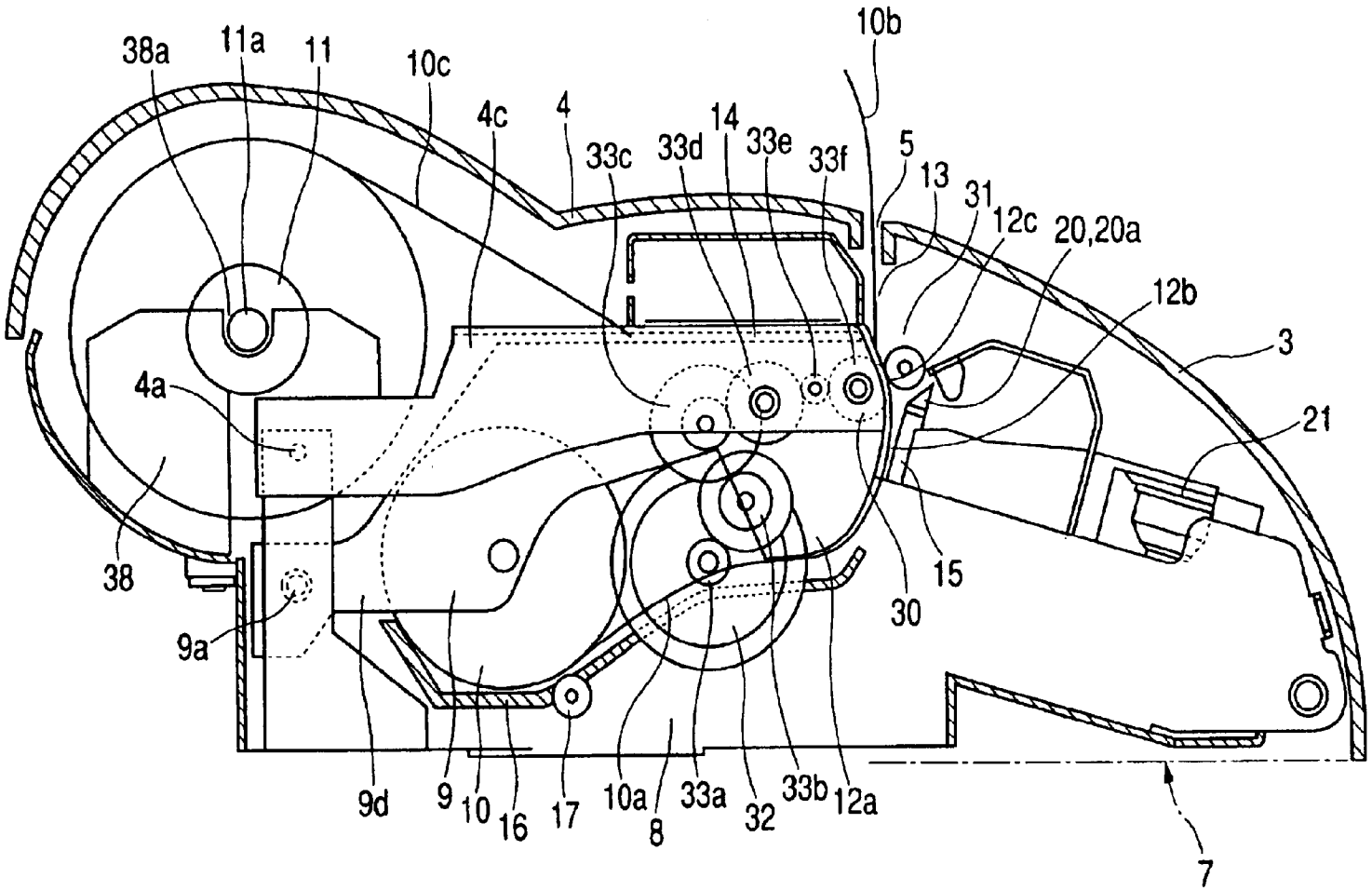
FIG. 3 is a left side view of the printer body.

As shown in FIGS. 1 to 3, a printer 1 comprises a case body 2 in the shape of a rectangular frame defining four side faces of the printer 1, a front cover 3 and a rear cover 4 for covering respectively a front area and a rear area of an upper face of the printer. The above described members constitute a printer casing. It is to be noted that a direction as shown by an arrow A is defined as a front side, a direction as shown by an arrow B as a rear side, a direction as shown by an arrow C as a left side, and a direction as shown by an arrow D as a right side, herein in this specification.

A printer body 7 is incorporated in the printer casing, and a paper outlet 5 is formed at a position between the front cover 3 and the rear cover 4. When a slide button 6 is operated, a lock mechanism, which is not shown, will be released thereby to open the rear cover 4. Exchange of a winding shaft 11 and rolled recording paper 10 is conducted by opening the rear cover 4. Exchange of a ribbon cassette 21 of an ink ribbon for printing is conducted by opening the front cover 3.

Now, with reference to FIGS. 2 and 3, schematic arrangement of devices in the printer body 7 will be described.

The printer body 7 which is covered with the front cover 3 and the rear cover 4 includes a fixed frame 8 and a movable frame 9. The rear cover 4 is attached to right and left arm portions 4*b*, 4*c* which are mounted on the fixed frame 8 through rotary bearings 4*a* so as to be opened or closed. The movable frame 9 is attached to the fixed frame 8 through rotary; bearings 9*a* and is so designed as to be opened or closed by rotating around the rotary bearings 9*a*. In a closed state, the movable frame 9 is secured by a lock mechanism, which is not shown, and the lock mechanism will be released by operating a lever 9*b*, thus permitting the movable frame 9 to be opened.

A chamber 16 for staring the rolled recording paper 10 is formed in the rear side of the fixed frame 8 which is covered with the rear cover 4. In this embodiment, the rolled recording paper 10 is double-ply rolled paper. A double-ply recording paper 10*a* which has been drawn out from the rolled recording paper 10 is transported through a transporting passage 12 including a first passage 12*a*, a second passage 12*b* and a third passage 12*c* (described later in detail). Thereafter, printing is performed while the recording paper 10*a* passes between a printing head 20 provided in the second passage 12*b* and a platen 15, which is opposed to a printing face 20*a* of the printing head 20 with a fixed distance therebetween. Then, the recording paper 10*a* is caught between a paper feeding roller 30 and a paper pressing roller 31 provided in the third passage 12*c*, and transported by rotation of the paper feeding roller 30. The paper feeding roller 30 is rotated by a driving mechanism including a driving motor 32 and a gear train 33*a* to 33*f* (described later in detail), as shown in FIG. 3.

After the recording paper 10*a* has passed through the third passage 12*c*, the recording paper 10*a* is separated into a first separated paper 10*b* at a side of the printing head 20 and a second separated paper 10*c* at a side of the platen 15 to be transported through separate passages. The first separated paper 10*b* is transported upward through an ejection passage 13 which is connected to an upper part of the third passage 12*c* and ejected from the paper outlet 5 to the exterior of the printer 1. An automatic cutting mechanism 40 is provided in the ejection passage 13 to cut the first separated paper 10*b*.

The second separated paper 10*c* is transported backward through a winding passage 14, which is formed between a lower face of the automatic cutting mechanism 40 and an upper face of the movable frame 9, and wound up around the winding shaft 11 which is positioned in the rear side of the fixed frame B. As shown in FIG. 2, driving power for rotating the paper feeding roller 30 is transmitted by a winding mechanism which includes a gear train 35*a* to 35*c*, a transmitting mechanism 36*a* to 36*c*, and a gear train 37*a*, 37*b* thereby to rotate the winding shaft 11 (described later in detail).

Figure 4:
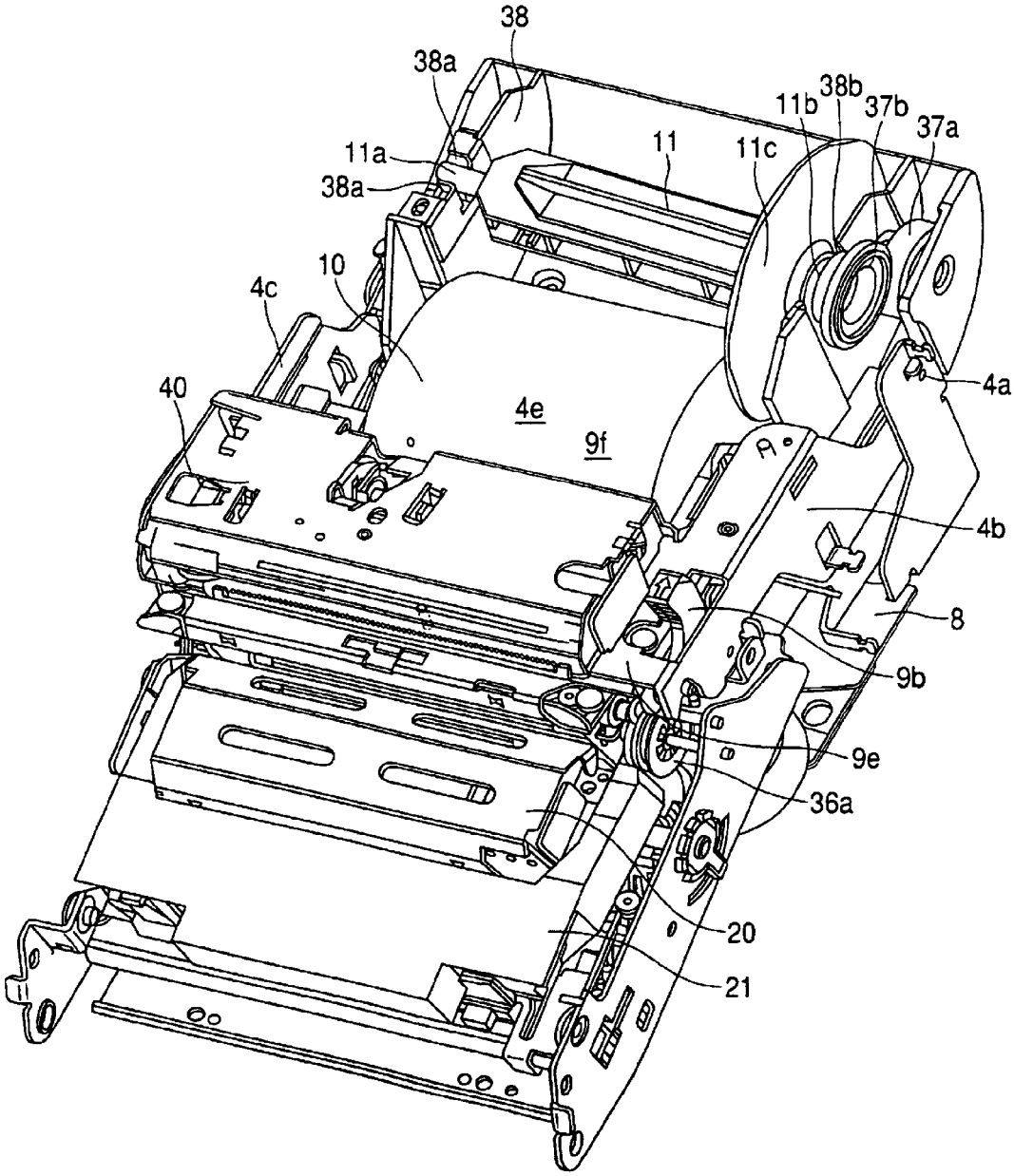
FIG. 4 is a perspective view of the printer body; showing a state that a movable frame of the printer is closed.

Now, brief explanation will be given concerning the opening and closing motion of the rear cover 4, which covers the movable frame 9 from above. Both the movable frame 9 and the rear cover 4 are adapted to be pivoted about their rear end part so as to be independently opened or closed. The rear cover 4 is attached to the right arm portion 4*b* and left arm portion 4*c*, which pivot about the rotary bearings 4*a* as the pivotal centers. The automatic cutting mechanism 40 is mounted on a front end portion 4*d* connecting the arm portions 4*b* and 4*c*. As shown in FIG. 4, the rear cover 4 has a large opening 4*e* in an area positioned above the rolled recording paper 10 which is stored in the bucket 16, and surrounded by the automatic cutting mechanism 40 attached to the front end portion 4*d* and the arm portions 4*b*, 4*c*. The opening 4*e* is wide enough that when the rear cover 4 has pivoted about the rotary bearings 4*a*, the rear cover 4 may not interfere with the winding shaft 11 which is mounted on a support part 38 provided on the fixed frame 8. Therefore, due to the presence of the opening 4*e*, the rear cover 4 can be opened or closed without interfering with the winding shaft 11, even though the winding shaft 11 is positioned in the opening path of the rear cover 4.

When the rear cover 4 is opened, the ejection passage 13 is opened, and the first separated paper 10*b* can be easily set. At the same time, because the automatic cutting mechanism 40 is separated from the movable frame 9 by opening the rear cover 4, the winding passage 14 is opened, so that also the second separated paper 10*c* can be easily set.

Moreover, the platen 15 and the paper feeding roller 30 are provided in a front and portion of the movable frame 9, and the transporting passage 12 is opened by opening the movable frame 9 so that the recording paper 10*a* can be easily set.

Next, with reference to FIG. 2, movements of the double-ply recording paper 10*a*, the first separated paper 10*b*, and the second separated paper 10*c* and structures of the transporting passage 12 will be described in detail.

The double-ply recording paper 10*a* which has been drawn out from the rolled recording paper 10 stored in the bucket 16 is guided to the transporting passage 12 by a guide roller 17, which is positioned in a forward end area of the bucket 16.

The transporting passage 12 includes the first passage 12*a*, which is provided ahead of the guide roller 17 and slightly inclined upward, the second passage 12*b*, which extends upward from the forward end of the first passage 12*a* at a large inclination angle, and the third passage 12*c*, which is inclined backward from an upper end of the second passage 12*b*:

The second package 12*b* is formed between the printing head 20 of a dot impact type and the platen 15 which is opposed to the printing face 20*a* of the printing head 20 with a fixed distance between them. Printing is performed by the printing head 20, while the recording paper 10*a* passes through the second passage 12*b* via the first passage 12*a*. The ribbon cassette 21 is detachably mounted on the printing head 20, and the ink ribbon in the ribbon cassette 21 is set between the printing face 20*a* and the platen 15. The ribbon cassette 21 can be exchanged by opening the front cover 3.

The third passage 12*c* continued from the second passage 12*b* includes the paper feeding roller 30 provided on the movable frame 9 and the paper pressing roller 31 attached to the fixed frame 8, and the recording paper 10*a* is adapted to be nipped between the two rollers to be transported. The paper feeding roller 30 is rotated by the driving mechanism which will be described below, to transport the recording paper 10*a*. The paper pressing roller 31 is urged toward the paper feeding roller 30 by a spring force.

The double-ply recording paper 10*a* is separated in an upper part of the third passage 12*c* to be transported to the two transporting passages. The first separated paper 10*b* is transported to the ejection passage 13, which is connected to the upper part of the third passage 12*c*. The first separated paper 10*b* is transported upward substantially vertically in the ejection passage 13, and ejected from the paper outlet 5 to the exterior of the printer 1. The ejection passage 13 is provided with the automatic cutting mechanism 40 which is attached to the rear cover 4, and the recording paper 10*b* is cut by the automatic cutting mechanism 40 after printing is performed. The automatic cutting mechanism 40 is positioned in the upper part of the front end portion 9*e* of the movable frame 9.

The lower face of the automatic cutting mechanism 40 and the upper face of the movable frame 9 are opposed to each other so as to define the winding passage 14 therebetween. Because the automatic cutting mechanism 40 is attached to the right and left arm portions 4*b*, 4*c* together with the rear cover 4, the winding passage 14 can be opened, by opening the rear cover 4.

The second separated paper 10*c* facing the platen 15 changes its transported direction backwards by approximately 90 degrees after having passed through the third passage 12*c*, and is transported backward through this winding passage 14. Then, the second separated paper 10*c* arrives at the winding shaft 11, and is wound up by the rotation of the winding shaft 11. The winding shaft 11 is provided with a claw, and the second separated paper 10*c* can be wound up without slipping. Incidentally, a leasing end of the second separated paper 10*c* is engaged with this claw in advance.

Both right and left ends 11*a*, 11*b* of the winding shaft 11 are dropped and fitted in grooves 38*a*, 38*b* of the support part 38, which is provided on the fixed frame 8, so as to mount the winding shaft 11 in a rotatable manner.

Since these grooves 38*a*, 38*b* are opened upward, the winding shaft 11 can be easily detached by being simply lifted upward.

The winding shaft 11 is rotated by the driving power of the driving motor 32 for the paper feeding roller 30, synchronously with the rotation of the paper feeding roller 30.

In FIG. 4, the automatic cutting mechanism 40 is provided above the movable frame 9. The automatic cutting mechanism 40 is attached to the arm portions 4*b*, 4*c* together with the rear cover 4, and the rear cover 4 can be opened independently in a state where the movable frame 9 is closed. In this case, the ejection passage 13 and the winding passage 14 are opened.

Figure 5:
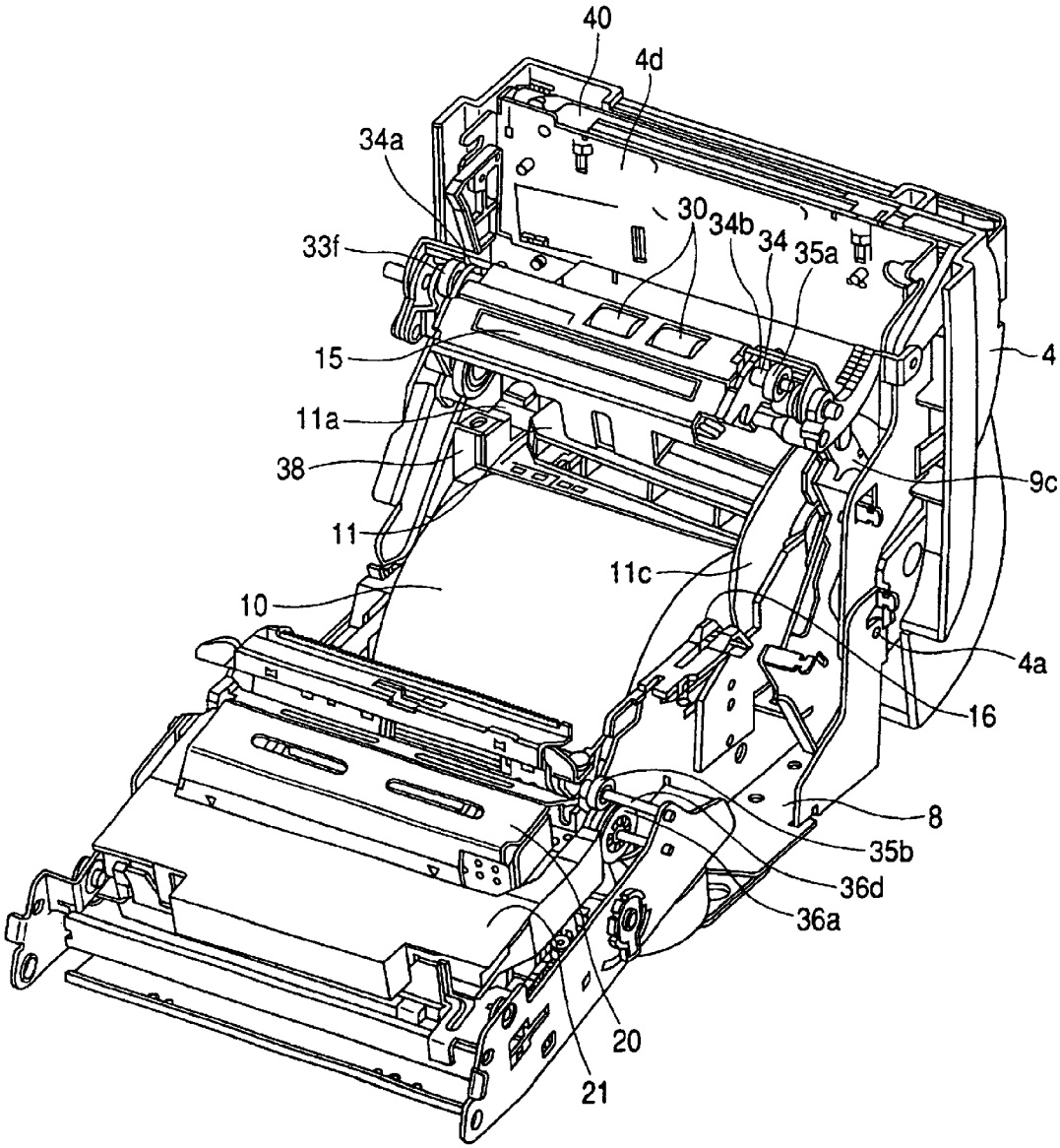
FIG. 5 is a perspective view of the printer body; showing a state that the movable frame is opened.
Figure 6A:
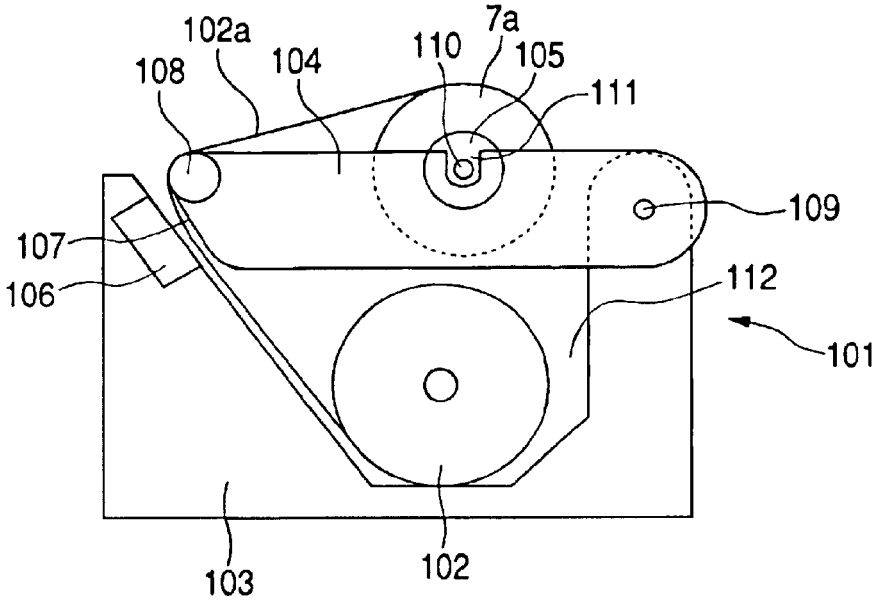
FIG. 6A (PRIOR ART)
FIGS. 6A and 6B are side views schematically showing a related-art printer.
Figure 6B:
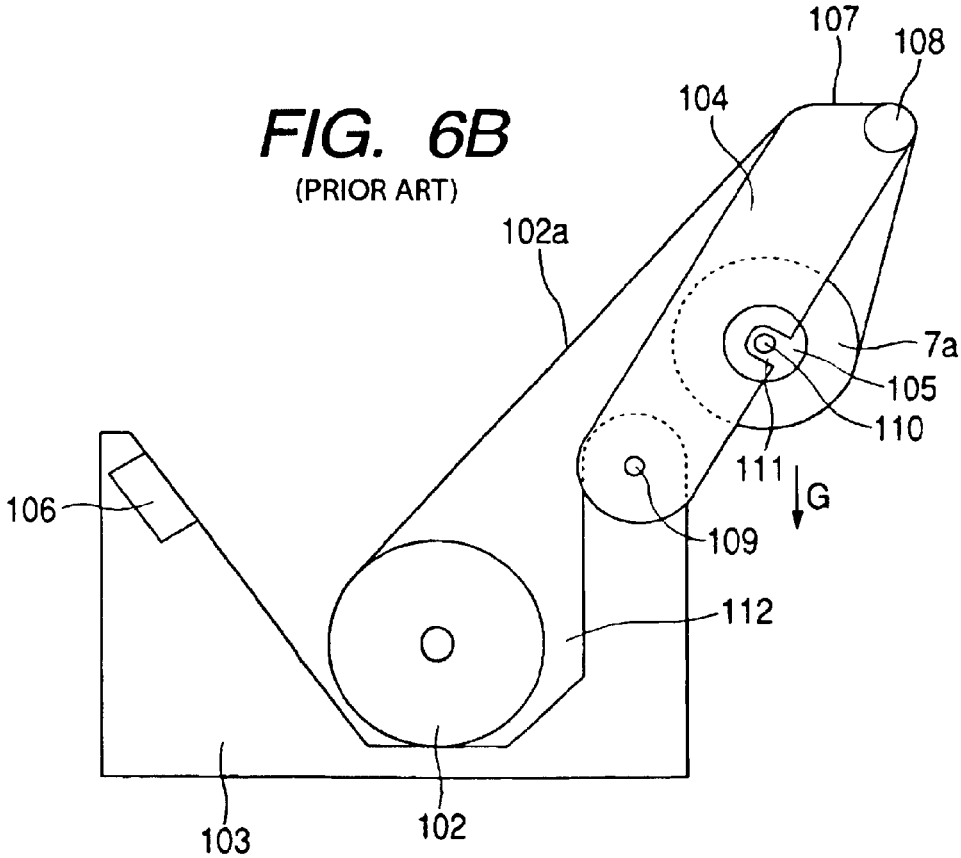
FIG. 6B (PRIOR ART)

When the movable frame 9 is opened, the transporting passage 12 is also opened as shown in FIG. 5, so that the roiled recording paper 10 and the winding shaft 11 can be easily exchanged. In other words, since all the members defining the transporting passage 12 are provided with any one of the fixed frame 8 and the movable frame 9, the transporting passage 12 can be completely opened by opening the movable frame 9.

More specifically, as shown in FIGS. 2 and 3, a lower wall of the first passage 12*a*, the printing head 20 having the printing face 20*a* which defines the second passage 12*b*, and the paper pressing roller 31 which defines the third passage 12*c* are provided at the side of the fixed frame 8. On the other hand, an upper wall of the first passage 12*a*, the platen 15 which defines the second passage 12*b*, and the paper feeding roller 30 which defines the third passage 12*c* are provided at the side of the movable frame 9.

As shown further in FIGS. 4 and 5, the movable frame 9 includes the right arm portion 9*c* and the left arm portion 9*d* extending in a front-rear direction, and the front end portion 9*e* connecting the arm portions 9*c*, 9*d*. The movable frame 9 is adapted to be pivoted about the rotary bearings 9*a*. The winding passage 14 is formed between an upper face of the front end portion 9*e* and the lower face of the automatic cutting mechanism 40.

As is apparent from FIG. 4 the movable frame 9 has a large opening 9*f* at a position above the bucket 16 and the winding shaft 11, in the same manner as the rear cover 4. Due to the fact that the movable flame 9 has the opening 9*f*, which can be opened or closed even in a state where the winding shaft 11 is positioned in the opening path of the movable frame 9 as shown in FIG. 5, the movable frame 9 can be opened or closed without interfering with the winding shaft 11 up to a diameter of a flange 11*c* of the winding shaft 11, even where the second separated paper 10*c* which has been wound around the winding shaft 11 becomes a roll having a large diameter.

Further, because the winding shaft 11 is not provided on the movable frame 9, there is no concern that the winding shaft 11 may fall, and the movable frame 9 can be opened up to a position that the rolled recording paper 10 can be easily exchanged.

Next, steps of setting the recording paper on the printer 1 from the state where the rear cover 4 and the movable frame 8 are opened as shown in FIG. 5 will be described. The rolled recording paper 10 can be loaded by simply dropping it in the bucket 16. Then, the double-ply recording paper 10*a* is drawn out from the rolled recording paper 10 so that its distal end portion can reach the winding shaft 11 via the transporting passage 12 and the winding passage 14. By closing the movable frame 9, the transporting passage 12 is formed and the recording paper 10*a* is automatically set. The movable frame 9 is automatically locked by the lock mechanism, which is not shown.

Then, the second separated paper 10*c* facing the platen 15 and coming from the upper part of the third passage 12*c* is set on the winding shaft 11 by engaging the leading end thereof with the claw provided on the winding shaft 11. Then, the winding shaft 11 is mounted on the fixed frame 8. Specifically, the winding shaft 11 is set by dropping both ends 11*a*, 11*b* of the winding shaft 11 into the grooves 38*a*, 38*b* of the support part 38, which is provided in the backward area of the fixed frame 8. The winding shaft 11 can rotate in contact with bottom faces of the grooves 38*a*, 38*b*.

At the same time, by dropping the one end 11*b* into the groove 38*b*, a spur gear 37*b* provided on the winding shaft 11 is meshed with another spur gear 37*a* which is provided on the support part 38. The driving power is transmitted to the spur gear 37*a* by way of a winding drive mechanism (described later in detail), and the winding shaft 11 is rotated by this driving power to wind up the second separated paper 10*c*.

On the other hand, the first separated paper 10*b* facing the printing head 20 is drawn out upward. By closing the rear cover 4 in this state, the first separated paper 10*b* extended upward is automatically set in the ejection passage 13, which is formed between the front cover 3 and the rear cover 4, and come into a state where its leading end portion is guided out from the paper outlet 5 to the exterior of the printer 1. Further, the second separated paper 10*c* is automatically set in the winding passage 14 which is formed between the lower face of the automatic cutting mechanism 40 and the upper face (an area of the front end portion 9*e*) of the movable frame 9. In the above described manner, the recording paper can be easily set in the printer 1.

Moreover, in a case where the recording paper has happened to be jammed during printing, it is possible to recover from the jammed state without cutting the recording paper, by opening the rear cover 4 and the movable frame 9.

Now, with reference to FIG. 3, the driving mechanism for rotating the paper feeding roller 30 will be described.

The driving mechanism includes the driving motor 32 and the gear train including gears 33*a* to 33*f*. The driving power of the driving motor 32 is transmitted to the paper feeding roller 30 by way of the gear train, which is provided at the left side of the printer 1, thereby to rotate the paper feeding roller 30.

More specifically, a motor gear 33*a* mounted on an output shaft of the driving motor 32 is meshed with a spur gear 33*b* to transmit the driving power. Thereafter, the driving power is transmitted from the spur gear 33*b* to spur gears 33*c*, 33*d* and 33*e* in this order, and then transmitted from the spur gear 33*e* to a spur gear 33*f* which is provided on a rotary shaft 34 to which the paper feeding roller 30 is mounted. Due to this power transmission by way of the gear train, the number of rotations of the driving motor 32 is decreased to the appropriate number of rotations of the paper feeding roller 30 that would be suitable for the paper transportation. In this manner, the paper feeding roller 30 rotates with the predetermined number of rotations, thereby to transport the recording paper 10*a* in cooperation with the paper pressing roller 31 which is in contact therewith.

The driving motor 32, the motor gear 33*a*, and the spur gear 33*b* are provided at the side of the fixed frame 8, and the spur gears 33*c*, 33*d*, 33*e*, and 33*f* are provided at the side of the movable frame 9. The spur gear 33*b* is meshed with the spur gear 33*c* when the movable frame 9 is closed.

The rotary shaft 34 to which the paper feeding roller 30 is mounted extends from the left side to the right side of the movable frame 9 as shown in FIG. 5, and is rotatably held by bearings 34*a*, 34*b* which are respectively provided on the left and right arm portions 9*d*, 9*c*. The spur gear 33*f* is mounted to a left part outside the bearing 34*a*, and the driving power of the driving motor 32 is transmitted to the rotary shaft 34 thereby to rotate the paper feeding roller 30.

As described above, the spur gear 33*f* is mounted to the left end of the rotary shaft 34, while the spur gear 35*a* is mounted to the right end at the opposite side so as to transmit the driving power to the gear train 35*a* to 35*c* of the winding drive mechanism. In other words, the rotary shaft 34 performs not only the function of transporting the recording paper 10*a* by rotating the paper feeding roller 30, but also the function of transmitting the driving power from the gear train 33*a* to 33*f*, which is arranged at the left end, to the gear train 35*a* to 35*c* of the winding drive mechanism, which is arranged at the right end.

With reference to FIG. 2, the winding drive mechanism for rotating the winding shaft 11 will be described. The winding drive mechanism includes the gear train having the spur gears 36*a* to 35*c* provided at the side of the paper feeding roller 30, the transmission mechanism having a pulley gear 36*a*, a pulley 36*b* and a belt 36*c*, and a gear train having spur gears 37*a*, 37*b* provided at the side of the winding shaft 11. The gear trains are disposed at the right side of the printer 1, while the gear train 33*a* to 33*f* of the driving mechanism for driving the paper feeding roller 30 is disposed at the left side of the printer, so as to attain an efficient layout with good balance for downsizing the printer.

The structure of the winding drive mechanism will be described in detail. The driving power of the driving motor 32 is transmitted to the spur gears 35*a*, 35*b* and 35*c* in this order. The gear pulley 36*a* comprises an outside pulley and an inside gear which are integrally formed. The inside gear is meshed with the spur gear 35*c*. The belt 36*c* is wound around the outside pulley 36*a* to transmit the driving power from the pulley gear 36*a* at the side of the paper feeding roller 30 to the pulley 36*b*, which is provided at the side of the winding shaft 11. The spur gear 37*a* is mounted on a rotation axis of the pulley 36*b* by a spring clutch which is not shown. The spur gear 37*a* is meshed with the spur gear 37*b* which is provided on the winding shaft 11.

According to the above described structure, the pulley 36*b* is rotated synchronously with the rotation of the paper feeding roller 30. In a case where the second separated paper 10*c* is slackened, the winding shaft 11 is rotated to wind up the second separated paper 10*c*, and in a case where the second separated paper 10*c* is stretched with tension, the rotation of the pulley 36*b* is restrained from being transmitted to the spur gear 37*a* by the spring clutch. In this manner, appropriate winding of the recording paper can be performed depending on the transport and slack of the recording paper.

In this structure, the spur gear 35*a* attached to the rotary shaft 34 of the paper feeding roller 30 is provided at the side of the movable frame 9, while the spur gears 35*b*, 35*c* and pulley gear 36*a* are provided at the side of the fixed frame 8. The spur gear 35*a* and the spur gear 35*b* are designed to be meshed with each other when the movable frame 9 is closed. As for the side of the winding shaft 11, the pulley 36*b* and the spur gear 37*a* are provided on the support part 38 of the fixed frame 8, and the spur gear 37*b* is attached to the end portion 11*b* of the winding shaft 11. When the end portion 11*b* of the winding shaft 11 is dropped into the groove 38*b*, the spur gear 37*a* and the spur gear 37*b* are meshed with each other.

Although the described transmission mechanism is employed to interconnect the side of the paper feeding roller 30 and the side of the winding shaft 11 in this embodiment. It is also possible that a gear train including spur gears or other power transmitting mechanisms may be employed.

There is another type of a printer which is not provided with the paper winder. In such a printer, the spur gears for the winding drive mechanism are not necessary. The rotary shafts 36*d* of the gear trains 35*a* to 35*c* are not securely fixed an the frames, but detachably attached thereto through the use of clip members, for example. In this case, the fixed frame 8 and the movable frame 9 are commonly used for printers provided with or without the paper winder. As a result, manufacturing efficiency can be enhanced.

It is to be noted that the invention is not limited to the above described embodiment, but various modifications can be made.

For example, although the double-ply recording paper is employed in the above described embodiment, it is possible to apply this invention to a journal printer exclusively for winding up single-ply recording paper. In this case, it is possible to employ only the transporting passage for winding the recording paper around the winding shaft, without providing the ejection passage and the automatic cutting mechanism.

In addition, this invention is applicable for a printer in which two rolls of recording paper are arranged side by side, and one of the rolls is ejected from the paper outlet while the other is wound around the winding shaft.

In the above described embodiment, the rear cover 4 is provided with the automatic cutting mechanism 40. However, the automatic rutting mechanism 40 may be omitted from the rear cover 4.

In the above described embodiment, the mechanism in which the support part 38 for supporting the winding shaft 11 has the grooves 38*a*, 38*b* which are opened upward, so that the winding shaft 11 can be mounted or detached by one action. However, the grooves 38*a*, 38*b* may be formed in an L-shape, so that the winding shaft 11 can be mounted or detached by two actions.

Further, the left end portion 11*a* of the winding shaft 11 in FIG. 4 may be received in a round hole or a vertically elongated hole. In this case, the end portion 11*a* may be first inserted, and thereafter, the end portion 11*b* may be dropped into the support part 38*b* to mount the winding shaft 11.

In the above described embodiment, the rear cover 4 and the movable frame 9 are pivotably held on the fixed frame 8 by the shafts. However, they may be held by a link mechanism.

The invention can be applied not only to a dot impact type printer, but also to an ink jet type printer or a thermal type printer. Because duplication can be easily obtained, the dot impact type printer is most preferable for a compact receipt journal printer.

In the above described embodiment, the platen 15 is held on the movable frame 9. Alternatively, the platen 15 may be held on the fixed frame 8, while a printing member such as a line thermal head may be held on the movable frame 9.

In a case where the invention is applied to the thermal type printer, the paper feeding roller may be embodied as a platen roller which also serves as a platen opposing to a thermal print head.

What is claimed is:

1. A printer comprising:

a fixed frame having a bucket in which rolled paper is stored;

a movable frame movably attached to the fixed frame such that a passage, through which paper drawn out from the rolled paper is transported, is formed between the fixed frame and the movable frame when the movable frame is placed at a first position, and such that the passage is opened when the movable frame is placed at a second position;

a printing head disposed at a printing section adjacent the passage, the printing head being provided on one of the fixed frame and the movable frame; and a winding shaft mounted on the fixed frame that winds up the paper transported through the printing section, wherein the movable frame is formed with an opening through which the winding shaft passes when the movable frame is moved between the first position and the second position.

2. The printer as set forth in claim 1, wherein the fixed frame comprises at least one groove receiving the winding shaft, the winding shaft being rotatable in the grooves.

3. The printer as set forth in claim 1, further comprising:

a paper feeding roller disposed adjacent the passage downstream of the printing section, the paper feeding roller being provided on one of the fixed frame end the movable frame; and a motor for rotating the paper feeding roller to transport the paper along the passage.

4. The printer as set forth in claim 3, wherein the winding shaft is rotated synchronously with the paper feeding roller.

5. The printer as set forth in claim 4, wherein the winding shaft is rotated by the motor.

6. The printer as set forth in claim 5, further comprising:

a first transmission mechanism, provided in one of a left side and a right side of the printer to transmit a driving force from the motor to the paper feeding roller; and a second transmission mechanism, provided in the other one of the left side and the right side of the printer to transmit a driving force from the paper feeding roller to the winding shaft.

7. The printer as set forth in claim 3, wherein:

the passage includes a first passage extending from the printing section to an outlet, and a second passage extending from the printing section to the winding shaft, and the paper 15 double-ply paper so that a first separated paper is transported along the first passage to be ejected from the outlet, and a second separated paper is transported along the second passage to be wound around the winding shaft.

8. The printer as set forth in claim 1, further comprising a cover, attached to the fixed frame so as to cover the bucket, the winding shaft and the movable frame, the cover being pivotable independent from the movable frame.

9. The printer as set forth in claim 7, further comprising;

a cover attached to the fixed frame so as to cover the bucket, the cover being pivotable between a first position and a second position; and a cutting mechanism provided with the cover to cut the first separated paper, wherein:

a lower face of the cutting mechanism and an upper face of the movable frame define the second passage when the cover is placed at the first position; and the second passage is opened in a case when the cover is placed at the second position.

10. The printer as set forth in claim 1, wherein the printing head is a dot impact type head.

11. A printer, comprising:

a fixed frame having a bucket in which rolled paper is stored;

a movable frame pivotably attached to the fixed frame to pivot between a closed position and an opened position, the fixed frame and the movable frame in the closed position defining a paper transport passage;

a printing section disposed adjacent the paper transport passage; and a winding shaft mounted on the fixed frame that winds up paper transported through the printing section, the winding shaft being disposed in a path of the movable frame when the movable frame is pivoted from the closed position to the opened position, wherein the movable frame comprises an opening therein of a sufficient size that the winding shaft does not interfere with the movable frame pivoting from the closed position to the opened position.

* * * * *